US007833059B2

(12) United States Patent
Henrici et al.

(10) Patent No.: US 7,833,059 B2
(45) Date of Patent: Nov. 16, 2010

(54) LAMP SOCKET

(75) Inventors: Philipp Henrici, Arnsberg (DE); Erwin Lingemann, Arnsberg (DE); Klaus Kummerow, Menden (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 12/430,145

(22) Filed: Apr. 27, 2009

(65) Prior Publication Data

US 2010/0267273 A1 Oct. 21, 2010

(30) Foreign Application Priority Data

Apr. 15, 2009 (DE) ..... 20 2009 005 472 U

(51) Int. Cl.
*H01K 1/00* (2006.01)
*H01K 1/46* (2006.01)

(52) U.S. Cl. ..... 439/615

(58) Field of Classification Search ..... 439/612, 439/613, 615, 666, 667; 313/318.04
See application file for complete search history.

(56) References Cited

U.S. PATENT DOCUMENTS 3,107,134 A * 10/1963 Kerrigan ..... 439/135
3,775,634 A * 11/1973 Hasell et al. ..... 313/318.03
5,842,882 A * 12/1998 Sato et al. ..... 439/336
5,874,800 A 2/1999 Newman ..... 313/318.04

* cited by examiner

*Primary Examiner*—Javaid Nasri
(74) *Attorney, Agent, or Firm*—Andrew Wilford

(57) ABSTRACT

A lamp socket has a housing forming a cavity centered on an axis and having a generally cylindrical side wall and a floor, an internally threaded sleeve coaxially received in the cavity, a central socket contact on the floor at the axis, and an annular disk separate from the housing, surrounding the central contact. The disk is formed on the axis with a central aperture and is spaced at the aperture substantially further from the floor than the central socket contact. Thus only a lamp base with a central lamp contact on an extension stem can fit in the socket and engage through the aperture and past the disk to make contact with the central socket contact.

8 Claims, 4 Drawing Sheets

LAMP SOCKET

FIELD OF THE INVENTION

The present invention relates to a lampholder or socket. More particularly this invention concerns a lamp socket for an EX39 lamp.

BACKGROUND OF THE INVENTION

A standard bulb or lamp has a normally glass envelope and a base serving both for mounting of the lamp and for supplying electricity to the filament or electrodes that make the lamp generate light. The standard lamp base, for example of the E39 type, is generally cylindrical, with a side wall formed with a screwthread and an end face provided centrally with a button contact. The side wall is typically made of sheet metal, is normally clad with copper, and forms the other contact. The button contact at the end is flush or projects slightly axially from the base.

A socket for such a lamp has a side wall formed complementarily to the lamp base so that the lamp can be screwed into it. A floor of the socket has a central contact against which the base central contact bears when the lamp is screwed in. Typically the socket central contact projects upward somewhat from the floor of the socket, similar to how the lamp central contacts projects slightly downward from the base end face. This way a good electrical connection can be formed between the lamp and the base.

Certain lamps, for instance gas-discharge lamps, must only be used in certain fixtures because the lamps are capable of bursting so that they must be safely enclosed. In order to ensure that they are only used in certain sockets, these lamps have different bases, of which the E39 type is quite popular. The E39 base is of the type described above, in that it has a central base contact that is flush with or projects upward from the floor of the socket cavity.

Some models of lamps are, however, provided with an internal liner cage that eliminates the danger from explosion. Thus such a lamp does not need to be used in a closed fixture. Thus such a lamp is provided with an EX39 base. Such a base has a screwthreaded side like a standard E39 base, but at its end there is an extension stem on the end of which the central lamp contact is provided. The socket dedicated to such lamps has a floor provided around the central contact with a spacer that will prevent an E39-type lamp base from making electrical contact.

Thus an open fixture can be equipped with an EX39 socket and only explosion-proof EX39 lamps can work in it. If an E39-type lamp is screwed into it, the central base contact of such a lamp cannot be brought into engagement with the central socket contact. On the other hand if an EX39 lamp is used in a E39 socket, it will work just fine because its projecting central contact will easily contact the central socket contact. Thus if a given location has a mix of E39 and EX39 fixtures, the owner need only stock EX39 lamps because they will work in both types.

Such an EX39-type socket is known from U.S. Pat. No. 5,874,800. This socket has in the socket floor a recess inside which the central socket contact is arranged. A ceramic collar surrounding the recess extends toward the lamp base. When an E39 lamp is screwed into the socket, the lower end of the lamp base comes to rest on the collar before the central contact provided directly on the lamp base can make electrical contact with the central socket contact. Nonetheless, when an EX39-type lamp is used, the extension provided with the central base contact projects down into the recess formed by the collar and socket floor and in the final assembly position makes electrical contact with the central socket contact. As a result of this, though an E39 lamp can fit in an EX39 socket, it will not function, but an EX39 lamp can fit in an EX39 socket and function properly. An EX39 lamp can therefore be used in an open and closed fixture, but an E39 lamp can only be used in a closed fixture.

EX39 sockets are less popular than E39 sockets, since they are more expensive due to lower numbers that are manufactured. Also, practice has shown that the collar, which is usually made of the same ceramic material as the socket, can break when an E39 lamp is screwed in forcibly. Spacing of the socket-side central contact of the E39 lamp in the EX39 socket is thus no longer guaranteed. The safety function offered by coding is no longer available.

OBJECTS OF THE INVENTION

It is therefore an object of the present invention to provide an improved lamp socket.

Another object is the provision of such an improved lamp socket that overcomes the above-given disadvantages, in particular that is inexpensive to manufacture so the EX39 type socket is virtually the same cost as the simpler E39 socket.

SUMMARY OF THE INVENTION

A lamp socket has according to the invention a housing forming a cavity centered on an axis and having a generally cylindrical side wall and a floor, an internally threaded sleeve coaxially received in the cavity, a central socket contact on the floor at the axis, and an annular disk separate from the housing, surrounding the central contact. The disk is formed on the axis with a central aperture and is spaced at the aperture substantially further from the floor than the central socket contact. Thus only a lamp base with a central lamp contact on an extension stem can fit in the socket and engage through the aperture and past the disk to make contact with the central socket contact.

When the spacer means is an annular disk that is easy and cost-effective to produce and is mounted at a corresponding offset parallel to the socket floor in the cavity, socket housings made for E39 lamps can also serve for manufacture of EX39 sockets. Manufacturing and inserting the annular disk are two simple and cost-effective procedures that add nothing of consequence to the overall manufacturing costs of the socket. The annular disk is preferably made of metal or plastic. Both materials are substantially less fragile than ceramic, such that forcibly screwing in an E39 lamp base will not result in the spacer being destroyed.

A particularly preferred embodiment is characterized in that the annular disk is part of a threaded sleeve provided in the cavity for receiving the base screwthread. There is an added economizing effect in this construction. Threaded sleeves with integrated annular disks produce an axially relatively short construction. In comparison to the usual E39 threaded sleeve the inventive threaded sleeve is shortened by the axial distance of the annular disk from the base of the socket body. Reduced material use and manufacturing benefits result.

It is common for the housing itself not to form the thread for inserting the lamp base, instead the metallic threaded liner sleeve is provided for this purpose. Due to the above-mentioned modification of the threaded sleeve, the socket can be configured advantageously in particular with respect to assembly. Instead of mounting the threaded sleeve and the annular disk separately, now only one correspondingly adapted threaded sleeve has to be inserted into the housing, thus dispensing with one mounting procedure, resulting in a further drop in costs.

Furthermore the aperture of the annular disk is surrounded by a collar extending toward the lamp base, in particular a collar formed by deformation of the annular disk toward the lamp base. At the same time the collar can be formed by conical deformation of the annular disk toward the lamp base. The spacing can be defined particularly easily when the sleeve is made.

BRIEF DESCRIPTION OF THE DRAWING

The above and other objects, features, and advantages is will become more readily apparent from the following description, reference being made to the accompanying drawing in which.

SPECIFIC DESCRIPTION

Figure 1:
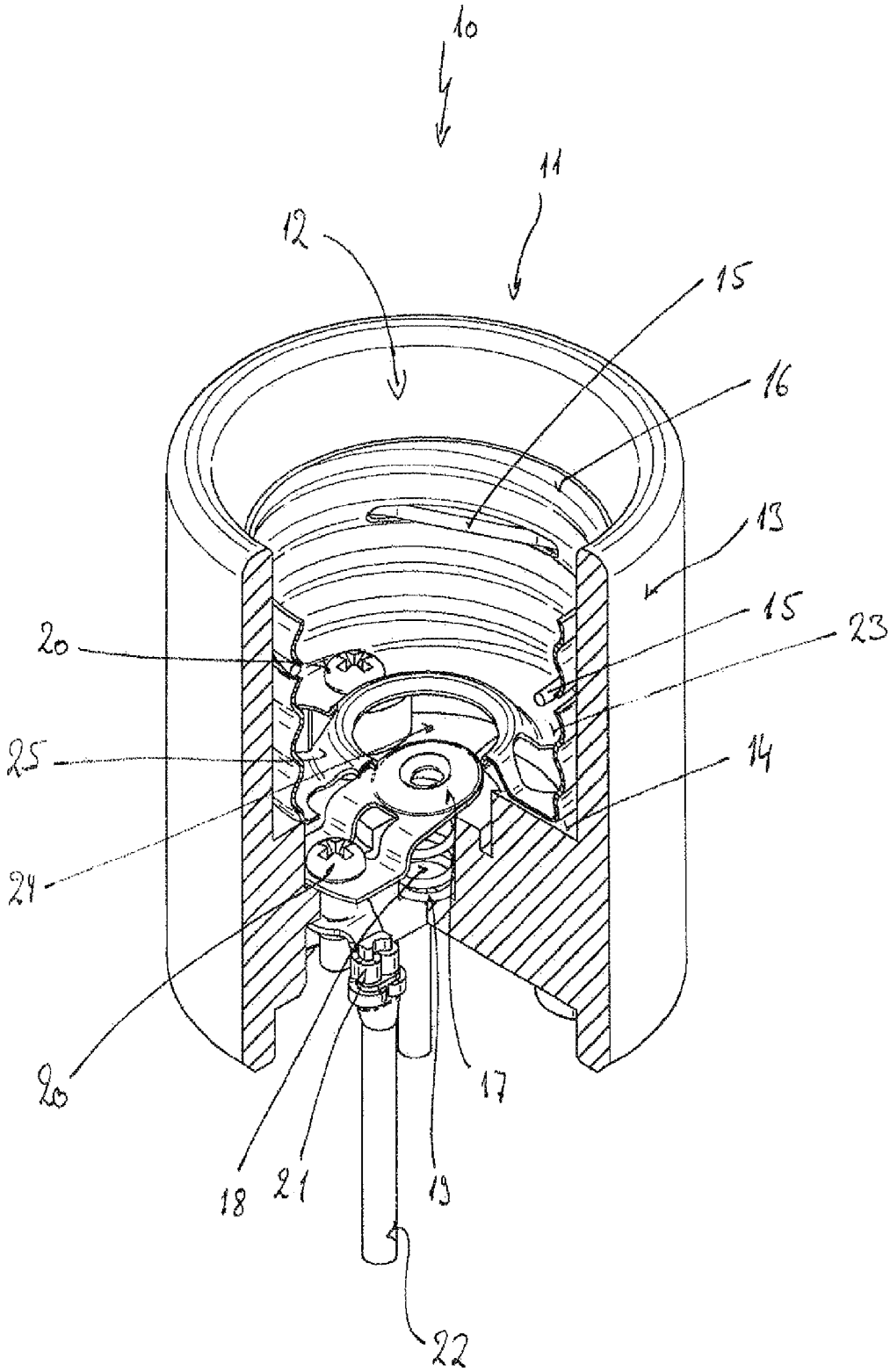
FIG. 1 is a perspective sectional view from above of an inventive lamp socket.
Figure 2:
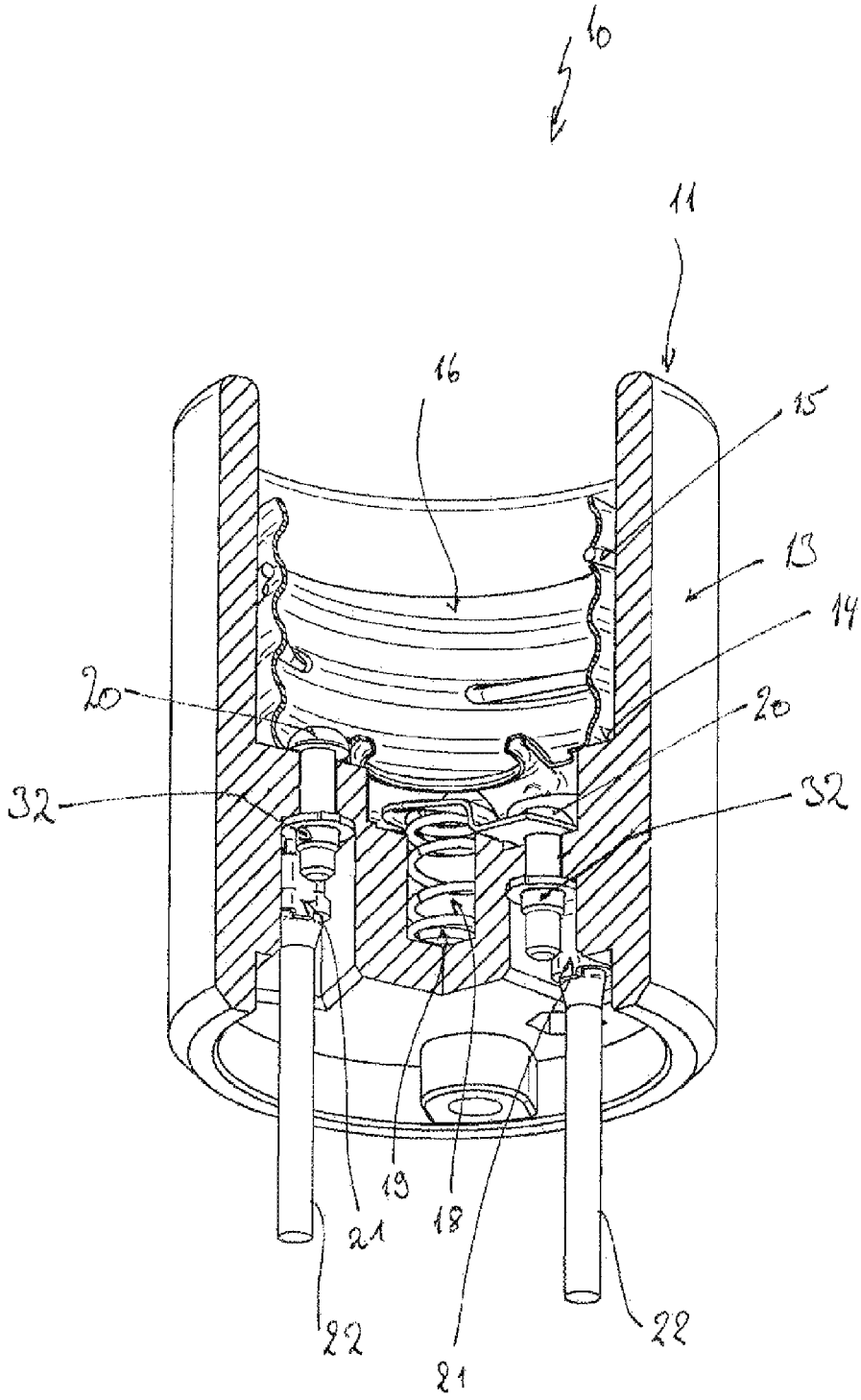
FIG. 2 is the view according to FIG. 1 but from below.

As seen in FIGS. 1 and 2 an EX39-type socket 10 comprises a plastic or ceramic housing 11 forming a normally upwardly open cavity 12 for receiving a lamp base. The cavity 12 has a generally cylindrical side wall 13 centered on an axis A and a transversely extending floor 14. A metallic liner sleeve 16 formed with a screwthread 28 (FIG. 3) lines the cavity 12. The side wall 13 is provided on its inner surface with gripper wires 15 that are springy and engage elastically through cutouts in the screwthreads of the socket sleeve 16.

A central socket contact 17 is provided above a recess 18 in the floor 14 in which a helical spring 19 is held that is braced upwardly against the central socket contact 17. The central socket contact 17 is cantilevered for limited vertical is movement in the housing 11 from a screw 20 serving as fastener. The socket contact 17 is also connected by the screw 20 to a sleeve 32 anchored in the housing 11 and via a crimp contact 21 to an electrical line 22. The threaded sleeve 16 receiving the lamp base 26 is also anchored by at least one screw 20 on the socket floor 14 and is connected thereby to another electrical line 22 via a crimp contact 21.

The threaded sleeve 16 is unitarily formed with a annular disk 23 with a central aperture 24. The annular disk 23 could be a separate part in the sleeve 16 and provided with appropriate retaining formations. The aperture 24 is surrounded by a frustoconical collar 25 tapering conically toward the lamp base from the annular disk 23 and formed unitarily therewith of the same sheet metal as the sleeve 16.

Figure 3:
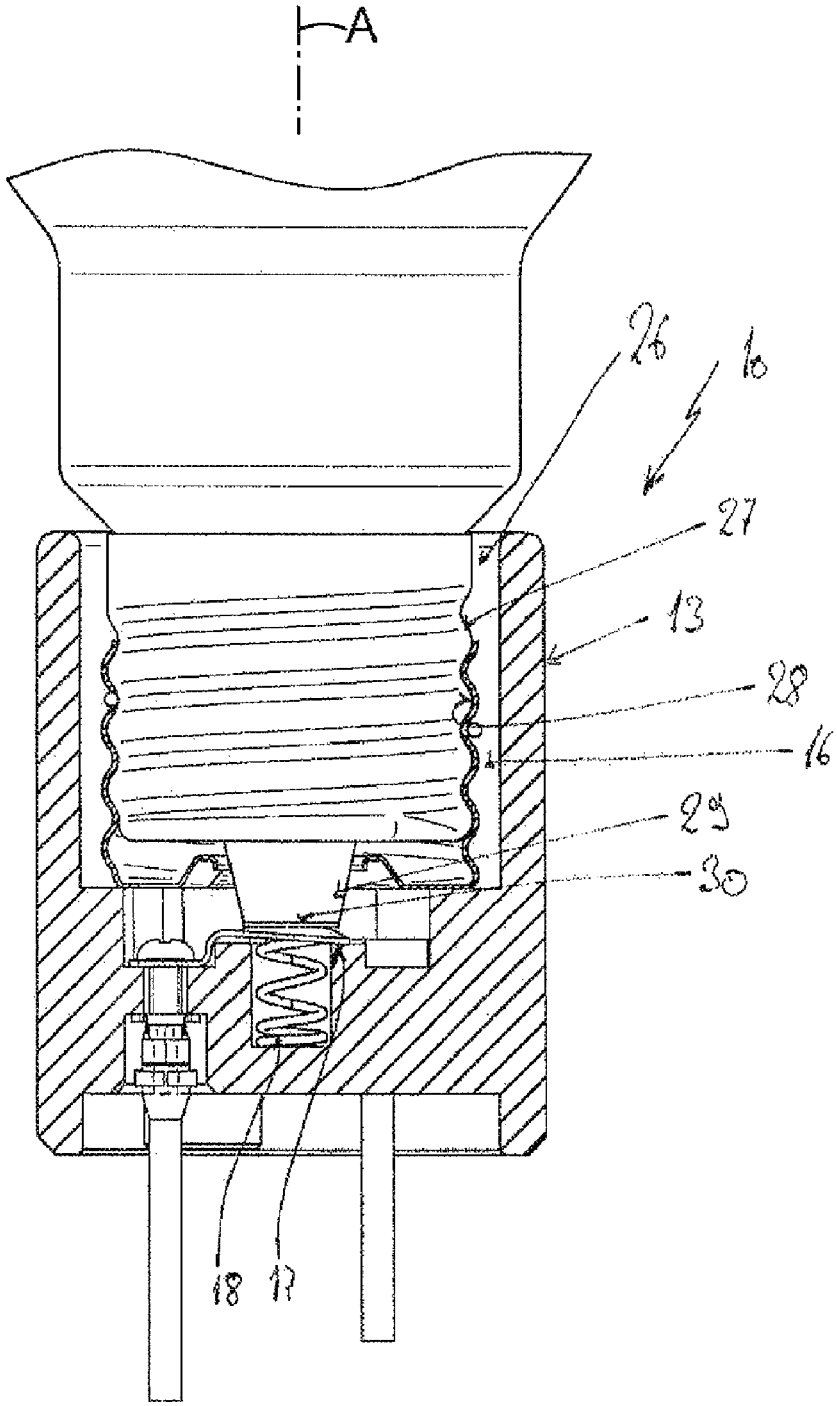
FIG. 3 is an section through inventive lamp socket according to the invention with an EX39 socket fitted to it.
Figure 4:
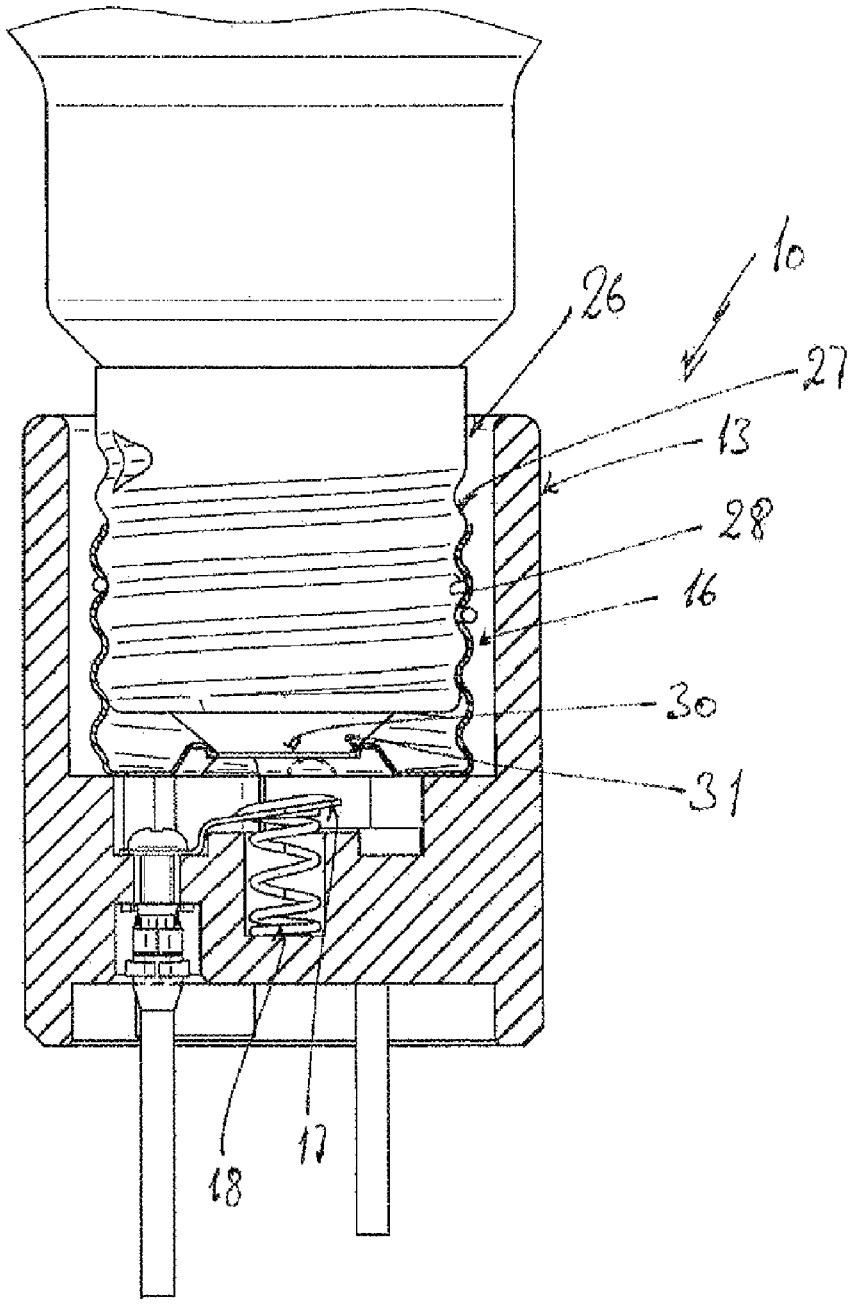
FIG. 4 is a view like with an inserted E39 lamp base.

The function of the lamp socket 10 can be described particularly clearly by comparing FIGS. 3 and 4. An EX39-type lamp is set in the lamp socket 10 in FIG. 3, but substantially only its base 26 is shown. This lamp base 26 is provided with a base screwthread 27 that engages in the inner thread 28 of the threaded sleeve 16. The base screwthread 27 constitutes the first electrical pole of the lamp. The lamp base 26 has on its underside extending down toward the socket floor 14 an extension stem 29 and arranged thereon a central base contact 30—also known as a central contact—forming the second pole of the lamp. The stem 29 engages through the disk aperture 24 whenever the lamp is screwed into the lamp socket 10. It comes to rest on the central socket contact 17 and displaces the latter against the biasing of the spring 19 toward the housing floor 14. The helical spring 18 pressing the central socket contact 17 onto the central contact 30 ensures good contact. When an EX39-type lamp according to FIG. 3 is inserted both poles thus electrically engage respective contacts of the socket 10.

The situation in FIG. 4 is different. Here the lamp base 26 of an E39 lamp is fitted to the lamp socket 10, the central contact 30 of which is secured to the lower end of the lamp base 26 only by an insulator 31. As a result of this, the central contact 30 cannot extend far enough through the annular disk aperture 24 and does not make electrical contact with the central socket contact 17. Lacking contact with both poles, the inserted E39 lamp base 26 shown in FIG. 4 cannot function.

The gripper wires 15 lie in cutouts extending parallel to the screwthread of the threaded sleeve 16. In the insertion region they slightly reduce the screwthread diameter. When the lamp base 26 is screwed into the lamp socket 10 the gripper wires are displaced elastically outward toward the wall 13 of the socket body and engage resiliently in the screwthread of the lamp base 26. As a result, static friction to be overcome when the lamp base 26 is unscrewed is increased such that loosening of the lamp base 26 by thermally caused changes in dimensions or jarring of the light fixture is securely prevented.

In summary, a novel EX39-type socket is provided in is which an annular disk 23, in particular a threaded sleeve 16 provided with an annular disk 23, serves as and thus guarantees a spacing from the central socket contact 17, so that only lamps of EX39 type can be used and function properly in the inventive lamp socket 10. Damage to or destruction of the annular disk 23 serving as spacer by a lamp being that is screwed in forcibly is securely prevented.

We claim:

1. A lamp socket for use in combination with an EX39 lamp base having a central lamp contact on an extension stem, the lamp socket comprising:

a housing forming a cavity centered on an axis and having a generally cylindrical side wall and a floor;

an internally threaded sleeve coaxially received in the cavity;

a central socket contact on the floor at the axis; and a metallic annular disk separate from the housing, surrounding the central contact, formed on the axis with a central aperture, and spaced at the aperture substantially further from the floor than the central socket contact, whereby only an EX39 lamp base with a central lamp contact on an extension stem can fit in the socket and engage through the aperture and past the disk to make contact with the central socket contact.

2. The lamp socket defined in claim 1 wherein the disk is unitarily formed with the sleeve.

3. The lamp socket defined in claim 2 wherein the disk is formed with an axially projecting collar forming the aperture.

4. The lamp socket defined in claim 3 wherein the collar is frustoconical and tapers away from the floor.

5. The lamp socket defined in claim 3 wherein the disk has outside the collar a basically planar outer region lying flatly on the floor.

6. The lamp socket defined in claim 3 wherein the collar is unitarily formed of metal with the disk.

7. The lamp socket defined in claim 1 wherein the disk and sleeve are both of metal and conductive.

8. A lamp socket for use in combination with an EX39 lamp base having a central lamp contact on an extension stem, the lamp socket comprising:

a housing forming a cavity centered on an axis and having a generally cylindrical side wall and a floor;

an internally threaded sleeve coaxially received in the cavity and formed with at least one cutout extending parallel to the screwthread of the sleeve;

to a spring projecting inward into the sleeve through the cutout;

a central socket contact on the floor at the axis; and a metallic annular disk separate from the housing, surrounding the central contact, formed on the axis with a central aperture, and spaced at the aperture substantially further from the floor than the central socket contact, whereby only an EX39 lamp base with a central lamp contact on an extension stem can fit in is the socket and engage through the aperture and past the disk to make contact with the central socket contact.

* * * * *